United States Patent [19]

Brady et al.

[11] Patent Number: 4,620,490

[45] Date of Patent: Nov. 4, 1986

[54] DOOR SEAL

[75] Inventors: Robert T. Brady, Elmhurst; James G. Guyon, Chicago, both of Ill.

[73] Assignee: Vapor Corporation, Chicago, Ill.

[21] Appl. No.: 539,042

[22] Filed: Oct. 4, 1983

Related U.S. Application Data

[62] Division of Ser. No. 300,242, Sep. 8, 1981, Pat. No. 4,422,387.

[51] Int. Cl.[4] ..... F23M 7/00

[52] U.S. Cl. ..... 110/173 R; 49/485; 126/190

[58] Field of Search ..... 110/173 R; 126/190; 49/485

[56] References Cited

U.S. PATENT DOCUMENTS

| | | | |
|---|---|---|---|
| 3,282,257 | 11/1966 | McInerney | 122/250 R |
| 3,327,429 | 6/1967 | Slaughter | 49/483 |
| 4,160,421 | 7/1979 | Heinen | 110/173 R |
| 4,211,536 | 7/1980 | Hamilton | 110/173 R |
| 4,302,262 | 11/1981 | Kay | 49/485 X |

*Primary Examiner*—Edward G. Favors

*Attorney, Agent, or Firm*—Francis J. Lidd

[57] ABSTRACT

A seal for an access door (44) mounted on a combustion chamber of a fluid heater includes a gasket pad (56) that is sealed to the interior surface of the door (52) by adhesive material. The gasket pad is secured to the door by first applying adhesive material to the interior surface of the door and the gasket pad. Thereafter, the gasket pad is attached to the coated area on the door covered by adhesive material.

11 Claims, 5 Drawing Figures

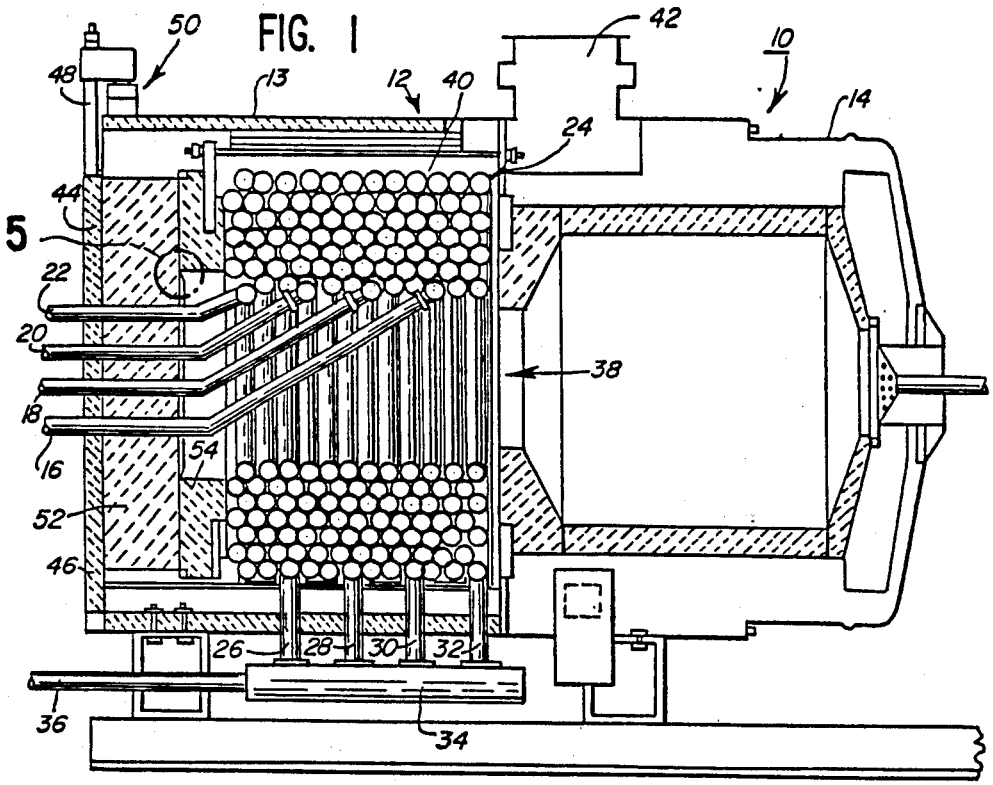
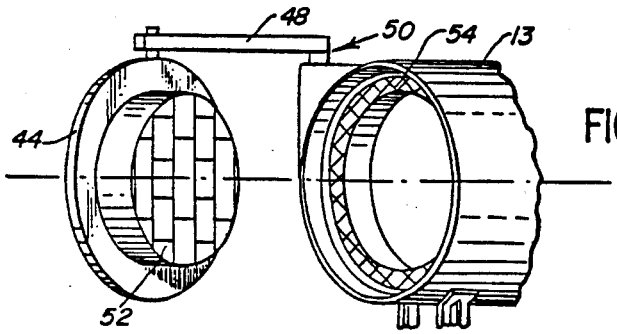
FIG. 2
FIG. 5
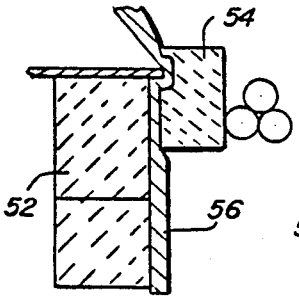
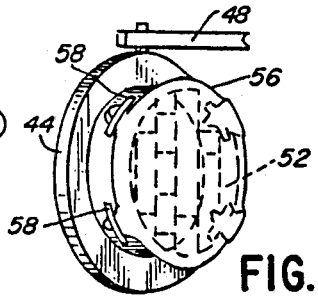
FIG. 3
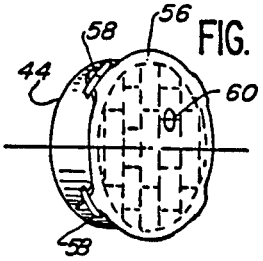
FIG. 4

DOOR SEAL

This application is a division, of application Ser. No. 300,242, filed Sept. 8, 1981 U.S. Pat. No. 4,422,387.

BACKGROUND OF THE INVENTION

The present invention relates to a new and improved seal for a door on a combustion chamber of a fluid heater or boiler and to the method for sealing the door and to the kit that may be used to seal the door.

Most combustion chambers of fluid heaters include a rear door at the opposite end of the combustion/heat exchanger structure to allow access for service and assembly. During operation of these prior art heaters over a substantial length of time, the refractory in the rear door deteriorates due to the intensity of radiation and the impingement of combustion products. This deterioration results in the loss of refractory and poor performance of the unit due to increased heat losses in the area of the door. It is desirable that this deterioration of the refractory in the door and resultant heat loss be eliminated or substantially reduced. In addition, it is also desirable that a kit or similar device be available such that doors on existing heaters can be sealed in order to avoid deterioration of the refractory and resultant heat loss.

SUMMARY OF THE INVENTION

The object of the present invention is to provide a new and improved device for sealing a door in a combustion chamber of a fluid heater.

Another object of the present invention is to provide a new and improved method for sealing a door in a combustion chamber of a fluid heater.

A still further object of the present invention is to provide a new and improved kit for sealing doors on existing combustion chambers in fluid heaters.

Briefly, the present invention is directed to a new and improved seal for sealing an access or rear door in a combustion chamber of a fluid heater. The seal includes a gasket to which is applied adhesive material. The gasket is then secured to the interior surface of the access door after adhesive material has also been applied to the surface. An observation port may be cut in the gasket if an observation port exists in the door.

BRIEF DESCRIPTION OF THE DRAWING

The above and other objects and advantages and novel features of the present invention will become apparent from the following detailed description of a preferred embodiment of the invention illustrated in the accompanying drawing; wherein:

FIG. 1 is a vertical, cross-sectional view of a fluid heater including a door sealed in accordance with the principles of the present invention;

FIG. 2 is a reduced, partially schematic view of an access door on the fluid heater illustrated in FIG. 1;

FIG. 3 is a partial view of the door illustrated in FIG. 2 with the seal applied thereto; and FIG. 4 is a view similar to FIG. 3 with an observation port provided therein.

FIG. 5 is a detailed section of circled portion 5 of FIG. 1, showing the seal and rear door in place.

DESCRIPTION OF THE PREFERRED EMBODIMENT

Referring initially to FIG. 1 there is illustrated a fluid heater generally designated by the reference numeral 10 of the type described in U.S. Pat. No. 3,282,257. The device of the present invention is a seal intended to seal the rear access door on a combustion chamber employed in a heater of the type described in U.S. Pat. No. 3,282,257. Accordingly, the fluid heater 10 will only briefly be described with the understanding that a more complete description of the fluid heater 10 may be obtained by reference to the above noted patent.

The fluid heater 10 includes a heat exchanger generally designated by the reference numeral 12 that includes a burner 14 and a coil housing 13. Not shown in FIG. 1 is a steam separating drum employed when said heater is used as a steam generator, that is connected through a manifold to a plurality of outlet water tubes 16, 18, 20 and 22. The outlet water tubes 16, 18, 20, and 22 are connected to a bank of water tubes generally designated by the reference numeral 24 that in turn are connected to inlet water tubes 26, 28, 30 and 32. The inlet water tubes 26, 28, 30, and 32 are in turn connected to an inlet manifold 34. The inlet manifold 34 is in turn connected to a recirculating water pump (not shown) through a pipe 36.

As will be readily understood by those skilled in the art, if the heater is used with high boiling point heat transfer liquids, this flow direction would be reversed. Liquid heating withoug entering the vapor phase is best accomplished by introducing the lowest temperature on return liquid where it comes in contact with the highest temperature combustion gases.

In steam generator operation, the hot combustion gases generated by the burner 14 are forced through a center opening 38 in the bank of water tubes 24 and radially outwardly to wipe across the surfaces of the water tube coil counter to the flow of the water through the coils and into a flue gas collection chamber 40 and from there into a stack connection or fitting 42 and out a stack connected thereto. The combustion products that pass from the burner 14 through the opening 38 impinge on and heat a rear door generally designated by the reference numeral 44. The rear door 44 is connected to a hinge 48 that is mounted on the housing 13 by a pivot hinge mechanism generally designated by the reference numeral 50. The inner surface of the door 44 is covered by brick or refractory material 52. The refractory material 52 abuts against an annular ring of firebrick 54 mounted within the housing 13. In the closed position (FIG. 1) the refractory material 52 abuts against the firebrick 54.

Typically, in the prior art the firebrick 52 is subject to high temperatures and the impingement of combustion product resulting in deterioration of the refractory or firebrick 52. It is this surface that is desired to be sealed in order to protect it from these deliterious effects. This surface is sealed by a pad or gasket 56 that is secured to the surface by an adhesive such as ceramic fiber coating cement such as Carborundum's "FIBERFRAX". The gasket or pad may be Fiberfrax Dura Blanket felt that is 8 lbs/ft$^3$ and one and one-half inches thick. Fiberfrax is the registered trademark of *The Carborundum Co,* Insulation Division, Niagara Falls, N.Y. The door 44 and specifically the surface 52 is first cleaned in preparation for the application of the gasket 56. Thereafter the surface 52 may be coated with the adhesive cement using a brush. One side of the gasket pad 56 is also coated with the adhesive cement and the coated surface of the gasket pad 56 is then placed upon the coated surface 52. The corners of the gasket pad 56 may be secured to the door 44 by pieces of masking tape 58 in order to hold the pad securely, and prevent interference between the door closure 44 and the firebrick 54.

After the pad 56 has been placed on the surface 52 and secured thereto by the masking tape 58, the door 44 may be closed and locked to assure proper setting of the seal. Closing the door/seal assembly provides a self adjusting, insulating, gas tight seal intermediate adjacent and mating peripheral surfaces of the door and combustion chamber (reference FIGS. 1 and 5). It should be noted that, as particularly shown in FIG. 5, applicant's discovery that utilizing a compressible ceramic fiber material positioned between the combustion chamber refractory 54, and refractory door surface 52, essentially establishes a labyrinth seal between the far end of the combustion chamber periphery and door mating surface. As indicated above, prior attempts at utilizing refractory cement in this type of seal were largely unsatisfactory, due to the inability of the cement to retain sufficient resilience during high temperature operation of the boiler. As will be well known to those skilled in the art, expansion and contraction of the adjacent refractory surfaces requires that a seal follow or expand and contract to fill voids created.

If the door 44 includes an observation port, an observation port 60 may be cut into the pad 56 as illustrated in FIG. 4.

Use of the unit disclosed for heating fluids other than water such as low vapor pressure (high boiling point) petroleum base heat transfer liquids is also contemplated. This so called "liquid phase" heating wherein the heating fluid is not allowed to change phase as in boiling results in nearly identical refractory temperatures. Therefore, the invention disclosed provides equivalent advantages for a wide range of fluid heating applications.

What is claimed and desired to be secured by Letters Patent of the United States:

1. In a fluid heater of the type including a housing, a burner in said housing, a fluid containing heat exchanger in said housing in heat transfer relationship with said burner, and an access door in said housing opposite said burner, said door including a peripheral edge and an inner surface, the improvement comprising;

a seal for said access door, said seal including a compressible gasket covering the interior surface of said access door extending over said surface of said door and beyond said surface to cover at least a portion of said peripheral edge of said surface, and means for adhering said gasket to said interior surface, said adhering means including separate means securing said gasket and said peripheral edge of door to each other.

2. The fluid heater set forth in claim 1 wherein said adhering means comprises a ceramic fiber cement.

3. The fluid heater set forth in claim 1 wherein said gasket comprises Fiber Frax Locon felt pad.

4. A method of sealing an access door in a combustion chamber of a fluid heater, comprising the steps of:

applying adhesive material to a gasket, securing said gasket to the interior surface of said door, and attaching peripheral edges of said gasket to said door by tape.

5. The method set forth in claim 4 further comprising the step of applying said adhesive material to the interior surface of said door.

6. The method set forth in claim 4 wherein said securing step further comprises the step of attaching said gasket to said door by tape.

7. The method set forth in claim 4 further comprising the step of cutting an observation port in said pad.

8. The method set forth in claim 4 further comprising the step of positioning said door and gasket in a closed configuration, thereby establishing said seal intermediate said door and chamber.

9. The method of sealing an access door in a fluid heater of the type having a housing, a refractory combustion chamber having an inlet and an outlet, and a cylindrically coiled heat exchanger having inlet and outlet ends, said heat exchanger inlet end in axial abutment with said chamber outlet, a burner in the inlet end of said chamber, and an access door in said housing adjacent said heat exchanger outlet end, comprising the steps of;

applying adhesive material to a preformed ceramic fiber gasket;

carrying said gasket to the interior surface of said door;

attaching said gasket to said door by attaching means;

positioning said door and gasket into a closed position thereby establishing a seal intermediate said door and chamber, and cutting an observation port in said gasket.

10. The method set forth in claim 9 further comprising the step of applying said adhesive material to the interior surface of said door.

11. The method set forth in claim 9 wherein said attaching step comprises attaching said gasket to said door by tape.

* * * * *